US006544613B1

(12) United States Patent
Varadarajan

(10) Patent No.: US 6,544,613 B1
(45) Date of Patent: Apr. 8, 2003

(54) COMPOSITE CONTAINER AND METHOD OF HEAT SEALING COMPOSITE CONTAINERS

(75) Inventor: Krishnaraju Varadarajan, Florence, SC (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 09/436,467

(22) Filed: Nov. 8, 1999

(51) Int. Cl.[7] ..... B29D 22/00; B29D 23/00; B32B 1/08; B65D 41/00

(52) U.S. Cl. ..... 428/36.9; 428/36.91; 428/36.92; 428/35.7; 428/36.6; 428/36.7; 220/359.1; 220/359.3; 220/359.4

(58) Field of Search ..... 220/359.2, 359.3, 220/359.4, 359.1; 229/123.2, 5.5; 428/35.7, 35.8, 35.9, 36.6, 36.7, 36.9, 35.91, 500, 515, 516, 36.92

(56) References Cited

U.S. PATENT DOCUMENTS

| | | | | |
|---|---|---|---|---|
| 3,973,719 | A | 8/1976 | Johnson et al. | |
| 3,990,615 | A | 11/1976 | Kerwin et al. | |
| 4,280,653 | A * | 7/1981 | Elias | 229/43 |
| 4,396,655 | A | 8/1983 | Graham et al. | |
| 4,397,401 | A | 8/1983 | Ueno et al. | |
| 4,469,258 | A | 9/1984 | Wright et al. | |
| 4,544,080 | A | 10/1985 | Wright et al. | |
| 4,656,068 | A | 4/1987 | Raines | |
| 4,771,938 | A | 9/1988 | Hambleton | |
| 4,801,041 | A | 1/1989 | Takata et al. | |
| 4,913,307 | A | 4/1990 | Takata et al. | |
| 4,957,820 | A | 9/1990 | Heyes et al. | |
| 4,978,056 | A | 12/1990 | Ball et al. | |
| 5,098,751 | A | 3/1992 | Tamura et al. | |
| 5,253,801 | A | 10/1993 | Bernstein et al. | |
| 5,353,985 | A | 10/1994 | Nägeli et al. | |
| 5,533,622 | A | 7/1996 | Stockley, III et al. | |
| 5,574,108 | A | 11/1996 | Antonov et al. | |
| 5,634,567 | A | 6/1997 | Hekal | |
| 6,302,290 | B1 * | 10/2001 | Engelaere | 220/359.4 |

FOREIGN PATENT DOCUMENTS

| | | |
|---|---|---|
| EP | 0 444 865 A2 | 9/1991 |
| EP | 0 952 087 A2 * | 10/1999 |

* cited by examiner

*Primary Examiner*—William P. Watkins, III
*Assistant Examiner*—Michael Miggins
(74) *Attorney, Agent, or Firm*—Alston & Bird LLP

(57) ABSTRACT

A sealed composite container is provided having a tubular body member and a liner ply adhered to the inner surface of the tubular body member. An end of the body member and liner ply is rolled outwardly to form a rim and a lid is heat sealed to the rim. A tacky composition is in contact with the rim and the lid and is positioned therebetween. The tacky composition has sufficient tackiness to temporarily hold the lid in place overlying the rim. At least one of the lid and liner ply comprises a seal layer comprising a heat sealable composition. The tacky composition and the heat sealable composition form a heat seal between the lid and the liner ply, the tacky composition being chemically compatible with the heat sealable composition such that a fusion seal is formed therebetween.

12 Claims, 4 Drawing Sheets

COMPOSITE CONTAINER AND METHOD OF HEAT SEALING COMPOSITE CONTAINERS

FIELD OF THE INVENTION

The present invention relates to food containers and methods and apparatus for making food containers, and more particularly relates to methods of sealing such containers.

BACKGROUND OF THE INVENTION

Food and drink products and other perishable items are often packaged in tubular containers, which are sealed at both ends. These tubular containers typically include at least one structural body ply and are formed by wrapping a continuous strip of body ply material around a mandrel of a desired shape to create a tubular structure. The body ply strip may be spirally wound around the mandrel or passed through a series of forming elements so as to be wrapped in a convolute shape around the mandrel. At the downstream end of the mandrel, the tube is cut into discrete lengths and is then fitted with end closures to form the container.

Tubular containers of this type typically include a liner ply on the inner surface of the paperboard body ply. The liner ply prevents liquids, such as juice, from leaking out of the container and also prevents liquids from entering the container and possibly contaminating the food product contained therein. Preferably, the liner ply is also resistant to the passage of gasses, such as oxygen and nitrogen, so as to prevent odors of the food product in the container from escaping and to prevent atmospheric air from entering the container and spoiling the food product. Thus, the liner ply provides barrier properties and the body ply provides structural properties.

In addition, current commercial containers often have membrane-type lids or end closures heat sealed to a curled or bead-shaped rim of the composite container wall to form a peelable seal. The rim is formed by turning outwardly the end of the container to position the inner layer of the liner material on the outwardly curved surface. The membrane-type lid is sealed to the liner on the rim by way of a heat sealable composition disposed on one or both of the membrane-type lid and the liner.

During construction of a sealed container of the type described above, a tacky paraffin wax is conventionally applied to the container rim in order to hold the lid in place prior to heat sealing. The wax interferes with the seal strength of the seal created between the membrane lid and the container. The lowered seal strength can result in poor high temperature and altitude performance and greater likelihood of seal failure. Vacuum-based systems that draw a vacuum within the container to hold the lid in place prior to heat sealing have been used as an alternative to the application of wax. However, such systems add equipment cost and complexity to the process. As a result, there remains a need in the art for a method of holding the lid in place prior to heat sealing without specialized equipment or adversely affecting the strength of the heat seal.

SUMMARY OF THE INVENTION

The present invention eliminates the use of conventional wax and vacuum machines, and advantageously provides a tacky composition that is compatible with the heat sealable composition used to create the heat seal between the liner of the container and the lid. The tacky composition of the present invention does not interfere with the seal strength of the heat seal and allows formation of a fusion seal between the lid and the container. The appropriate tacky composition is selected based on the type of material used to form the heat seal.

The present invention provides a sealed composite container comprising a tubular body member having at least one paperboard body ply and a liner ply adhered to the inner surface of the tubular body member. The liner ply comprises a barrier layer. At least one end of the body member and the liner ply are rolled outwardly to form a rim and expose the liner ply. A lid is positioned against the rim, the lid comprising a barrier layer. A tacky composition is in contact with both the rim and the lid and is operatively positioned therebetween. The tacky composition has sufficient tackiness to temporarily hold the lid in place overlying the rim prior to heat sealing. At least one of the lid and the liner ply further comprises a seal layer comprising a heat sealable composition. The tacky composition and the heat sealable composition form a heat seal between the lid and the liner ply. The tacky composition is chemically compatible with the heat sealable composition such that the two compositions are fusion sealed together.

In one embodiment, the tacky composition and the heat sealable composition both comprise a polymer material having a non-polar polymer backbone with at least one polar functional group connected thereto. For instance, the polar functional group may comprise carboxylic acid and the polymer backbone may comprise polyethylene. Preferably, the tacky composition has a melt flow index of about 20 g./10 min. to about 2000 g./10 min. Advantageously, the tacky composition is selected from a group consisting of ethylene/acrylic acid waxes, ethylene/acrylic acid copolymers, ethylene/methacrylic acid copolymers, polyvinyl alcohol and mixtures thereof. Preferably, the seal layer is selected from the group consisting of high density polyethylene, low density polyethylene, ethylene vinyl acetate, ethylene methyl acrylate, metallocene catalyzed polyolefins and mixtures thereof.

The present invention also provides a method of manufacturing a sealed container. The method includes providing a tubular member having at least one paperboard body ply and a liner ply adhered to the inner surface of the body ply. At least one end of the tubular member is rolled outwardly to form a rim. A lid is provided for closing the end of the tubular member, the lid comprising a barrier layer. Additionally, at least one of the lid and the liner ply further comprise a seal layer comprising a heat sealable composition, the seal layer being operatively positioned to form a heat seal between the lid and the liner ply. A tacky composition is applied to the rim and the rim and lid are contacted such that the tacky composition is positioned therebetween. In this manner, the tacky composition temporarily affixes the lid to the rim. The seal layer is heated under conditions sufficient to render the heat sealable composition of the seal layer flowable. The rim and lid are pressed together to form a heat seal therebetween, wherein the heat seal comprises the tacky composition and the heat sealable composition. Since the tacky composition is chemically compatible with the heat sealable composition, the two compositions are fusion sealed together, thereby hermetically sealing the lid to the liner ply.

The tacky composition may be applied by coating at least a portion of the outer surface of an applicator with the tacky composition and contacting the coated portion of the applicator with the rim of the container such that an amount of the tacky composition is applied to the rim. The applicator is preferably selected from the group consisting of brushes, rollers, and sponges.

BRIEF DESCRIPTION OF THE DRAWINGS

Some of the advantages of the present invention having been stated, others will appear as the description proceeds when taken in conjunction with the accompanying drawings, which are not necessarily drawn to scale, and wherein.

DETAILED DESCRIPTION OF THE INVENTION

The present invention now will be described more fully hereinafter with reference to the accompanying drawings, in which preferred embodiments of the invention are shown, and which are not necessarily drawn to scale. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
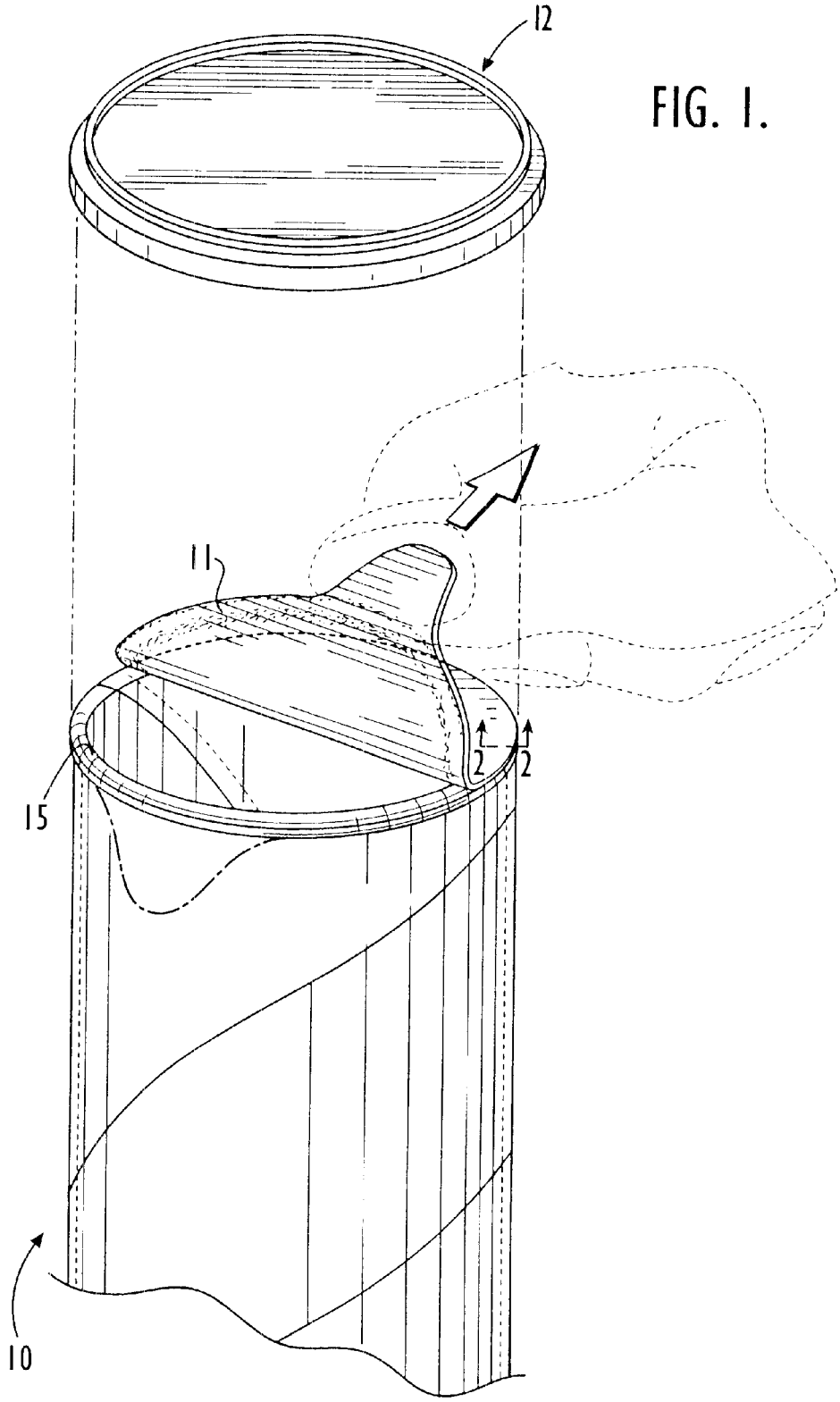
FIG. 1 is a fragmentary perspective view of a container of the present invention illustrating the opening mechanism.

A tubular container 10 according to the present invention is illustrated in FIG. 1. Although illustrated as having a circular cross section, the tube may have any cross sectional shape, which can be formed by wrapping the tube around an appropriately shaped mandrel. One example is a generally rectangular shaped tube having rounded corners.

The embodiment illustrated in FIG. 1 is particularly advantageous for packaging potato crisps and includes a flexible closure or lid 11, also referred to as a membrane-type closure or lid, and a reusable plastic end cap 12 over the seal. Various other end closures may be used; however, depending upon the type of food product that is to be packaged such as, for example, dough.

Figure 2:
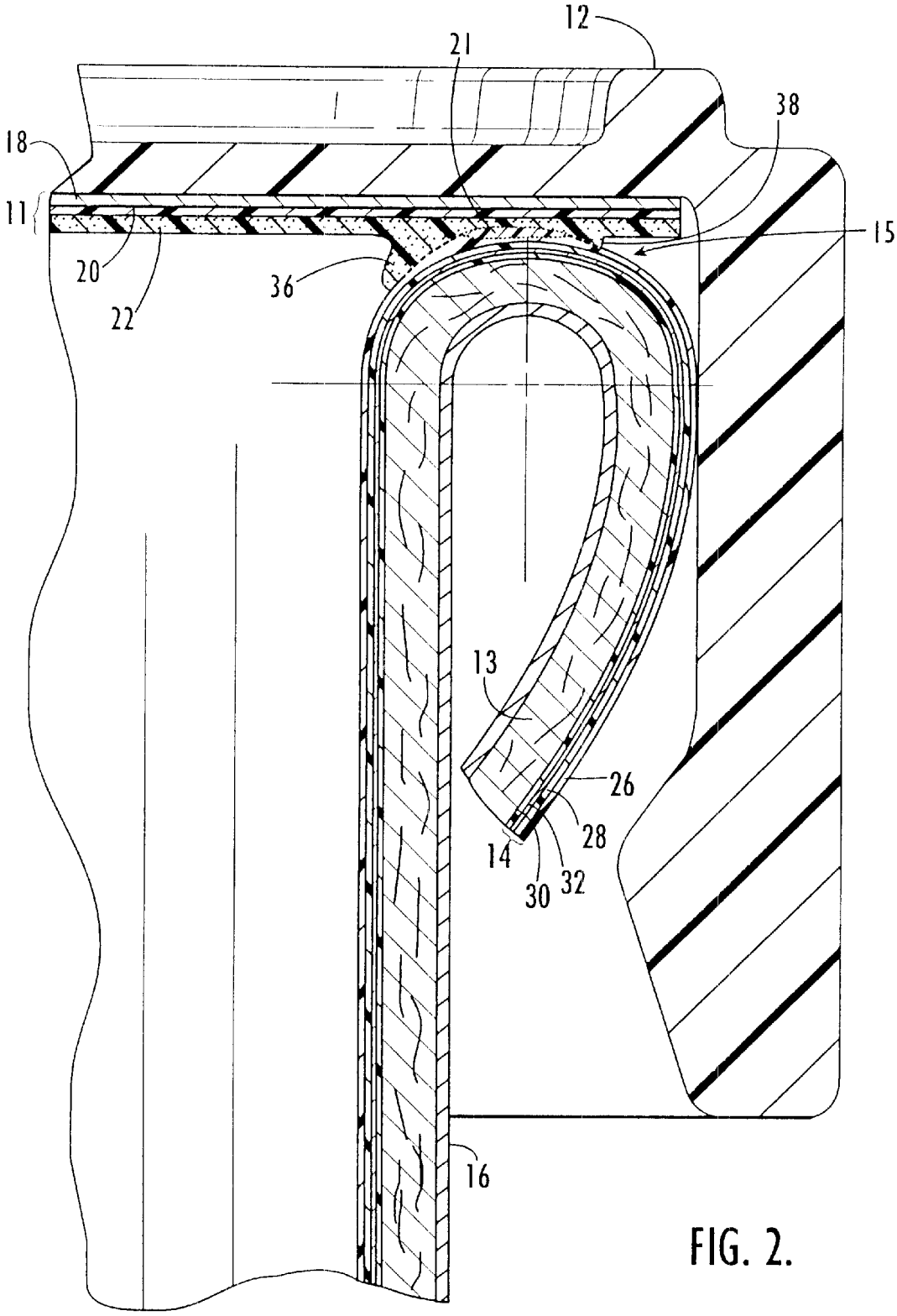
FIG. 2 is a fragmentary and enlarged view of the sealed end of the tubular container of an embodiment of the present invention.

As illustrated in more detail in FIG. 2, the tubular container 10 includes a wall having a body ply 13 which is preferably formed of paperboard and a liner ply 14 which is preferably formed of a polymeric material adhered to the inner surface of the body ply 13. The upper end of the tubular container 10 is rolled over so as to form a bead-shaped rim 15. The lid 11 is hermetically sealed to the top of the rim 15 as discussed below. Preferably, the rim includes a substantially planar portion as described in copending U.S. patent application Ser. No. 09/416,169, U.S. Pat. No. 6,234,396, which is herein incorporated by reference in its entirety. The end cap 12 is then snapped over the rim 15 and maybe reused after the lid 11 has been removed. A closure (not illustrated), for example a metal closure, can be secured to the opposite end of the container 10.

The lid 11 is constructed of multiple layers. A suitable lid construction is described in copending U.S. patent application Ser. No. 09/416,194, U.S. Pat. No. 6,302,321, which is herein incorporated by reference in its entirety. Optionally, the layer disposed on the outermost surface of the lid 11 away from the inside of the tubular container 10 is a paper or paperboard layer 18, such as a kraft paper layer. A barrier layer 20 is also provided that serves as a barrier to the passage of liquids and/or gasses such as oxygen. If a barrier is required for both liquids and gasses, the barrier material is preferably selected from the group consisting of metal foil, such as aluminum foil, polyethylene terephthalate, modified polyethylene terephthalate, polyethylene napthalate, polyamide, metallized polyester, metallized polypropylene, metallized polyamide and mixtures thereof. Suitable barrier layer 20 materials include foil, polyamide, metallized polyamide, polyvinylidiene chloride, polyethylene terephthalate, modified polyethylene terephthalate, metallized polyethylene terephthalate, metallized modified polyethylene terephthalate, polyethylene napthalate, metallized polyethylene napthalate, metallized polypropylene, metal oxide and silicate coated polyester, metal oxide and silicate coated polypropylene, ethylene vinyl alcohol and mixtures thereof.

Advantageously, the lid 11 further includes a seal layer 22 comprising a heat sealable composition and positioned such that the seal layer 22 of the lid 11 is adjacent to the seal layer 26 of the liner ply 14. The seal layer 22 of the lid 11 is preferably constructed of a material selected from the group consisting of ethylene vinyl acetate, high density polyethylene, low density polyethylene, ethylene methyl acrylate, metallocene catalyzed polyolefins and mixtures or blends thereof. The seal layer 22 of the lid 11 preferably has a melting point within the range of about 70° C. and 130° C. Most preferably, the melting point of the seal layer 22 is between about 80° C. and 110° C.

In one embodiment, the lid 11 is formed as a laminate having a paperboard layer 18 adhered to the barrier layer 20 using a coextruded adhesive layer (not shown). The adhesive layer is constructed of materials selected from the group consisting of ionomeric polymers, such as SURLYN® polymer, low density polyethylene, ethylene methyl acrylate (EMA), ethylene-methacrylic acid copolymers (EMAA) and mixtures thereof. The seal layer 22 is coated on the opposing surface of the barrier layer 20. The seal layer 22 may be formed by extrusion coating, as a blown film laminated by extrusion or as a blown film laminated with a thermoset adhesive. In one embodiment, the seal layer 22 is formed as a dual layer coextrusion of high density polyethylene and ethylene methylacrylate copolymer.

The seal layer 22 of the lid 11 is preferably between about 0.6 and about 3.0 mils in thickness, most preferably at least about 1.5 mils in thickness. The seal layer 22 comprises a heat sealable composition weight between about 10 to about 50 lbs./3000 $ft^2$ and preferably about 20 to about 40 lbs./3000 $ft^2$. Most preferably, the seal layer 22 has a heat sealable composition weight of about 25 lbs./3000 $ft^2$ or more. The relatively thicker seal layer 22 prevents natural variations in the container manufacturing process from affecting the consistency of the heat seal. For example, imperfections in the rim 15 and variations in the container height have a significant effect on the sealing process. The additional heat seal material fills any cracks and fissures created in the rim 15 and is also able to create a continuous seal around seams in the container wall, such as the seams created by anaconda folds or overlap seams in the liner. The additional seal material also contributes to better sealing by compensating for slight differences in container height that might otherwise lead to a reduction in seal strength.

The liner ply 14 is also typically constructed of multiple layers. The composition of the liner ply 14 is not critical to the present invention. Preferably, one of the layers forms a barrier to moisture and/or gasses, depending on the application. It will be understood that various barrier materials and liner plies could be employed depending upon the item being packaged. For example, conventional liners include a layer of foil backed with kraft paper. However, in a preferred embodiment, the liner ply 14 is substantially entirely formed of polymeric material. In particular, liner plies such as described in U.S. Pat. No. 5,829,669 to Drummond et al. or U.S. Pat. No. 5,846,619 to Cahill et al. both of which are assigned to the assignee of the present invention and are hereby incorporated by reference, may be used.

In the embodiment illustrated in FIG. 2, the liner ply 14 includes a seal layer 26, a moisture barrier layer 28 and an adhesive layer 30. The barrier layer 28 is resistant to the passage of liquids and gasses such as oxygen. If a high barrier is required for both liquids and gasses, preferred barrier materials are metallized polyester or metallized polypropylene. Some food products, such as juices, do not require a gas barrier and other barrier materials may be used (although the barrier may also be generally resistant to the passage of gasses). It will be understood that various barrier materials could be employed depending upon the item being packaged. For example, suitable barrier materials include foil, polyamide, metallized polyamide, polyvinylidiene chloride, polyethylene terephthalate, modified polyethylene terephthalate, metallized polyethylene terephthalate, metallized modified polyethylene terephthalate, polyethylene napthalate, metallized polyethylene napthalate, metallized polypropylene, metal oxide and silicate coated polyester, metal oxide and silicate coated polypropylene, ethylene vinyl alcohol, mixtures thereof and the like, as will be apparent to the skilled artisan.

One surface of the barrier layer 28 may include a thin metallized coating 32 to provide a metallic appearance and also to enhance the barrier properties. The metallized coating 32, which may be formed of aluminum, is significantly thinner than a foil layer, however, and is not necessary for strength or barrier properties in certain applications.

An adhesive layer 30 is preferably below the metallized coating 32 and defines the radially outermost surface of the liner ply 14. The adhesive layer 30 may have multiple layers coextruded together. The adhesive layer 30 may be selected from the group consisting of metallocene catalyzed polyolefins, ethylene-methacrylic acid, ethylene methyl acrylate, ethylene butyl acrylate, ethylene acrylic acid, ethylene vinyl acetate, and blends, mixtures and copolymers thereof. The adhesive layer 30 may also be a thermoset adhesive layer.

Figure 3:
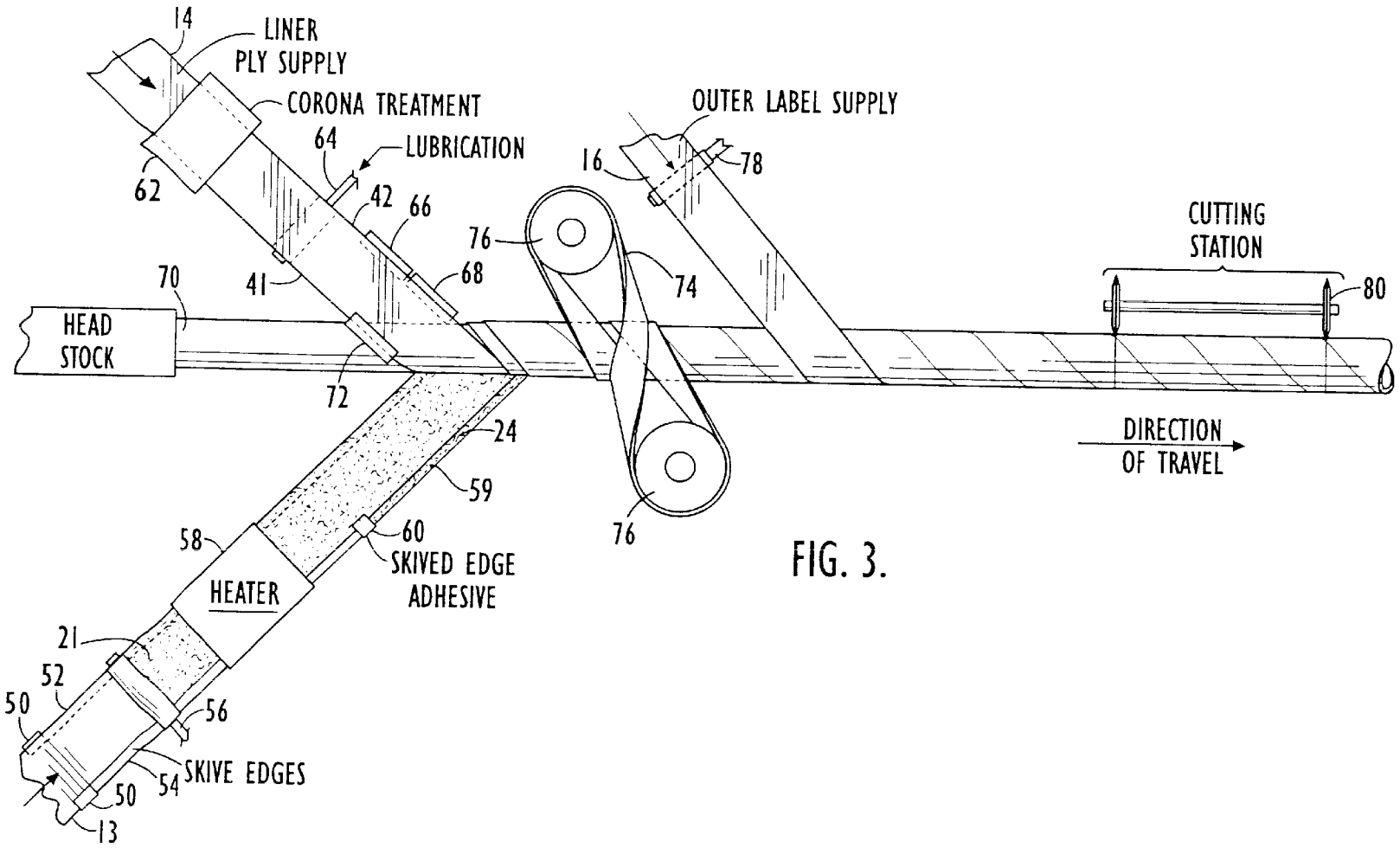
FIG. 3 is a plan view of an embodiment of an apparatus for making a tubular container according to the present invention.

A seal layer 26 defines the radially innermost surface of the liner ply 14. The seal layer 26 provides a surface against which the adhesive layer 30 is adhered when a first marginal edge portion 41 of the liner ply 14 is brought into an overlapping relationship with a second marginal edge portion 42, as shown in FIG. 3. The seal layer 26 also forms the heat seal between the lid 11 and the liner 14 in conjunction with the seal layer 22 of the lid.

The seal layer 26 of the liner ply 14 is preferably constructed of a material selected from the group consisting of ionomeric polymers, such as SURLYN® polymer, high density polyethylene, low density polyethylene, metallocene catalyzed polyolefins and mixtures or blends thereof. In embodiments of the seal layer 26 including a polyolefin polymer, the polyolefin is preferably high density polyethylene or a high density polyethylene blend containing up to 30% low density polyethylene. The seal layer 26 of the liner ply 14 preferably has a melting point within the range of about 110° C. and about 140° C. Most preferably, the seal layer 26 has a melting point between about 120° C. and 130° C.

As shown in FIG. 2, the sealed container of the present invention further comprises a tacky composition 21 positioned between the lid 11 and the rim 15. The tacky composition holds the lid 11 in place on the rim 15 prior to heat sealing the lid to the rim. The tacky composition 21 of the present invention is chemically compatible with the heat sealable compositions of the seal layers, 22 and 26. Thus, the tacky composition 21 does not interfere with the strength of the heat seal created between the lid 11 and the rim 15 of the container 10. Instead, a fusion seal is created between the tacky composition 21 and the heat sealable compositions of the seal layers, 22 and 26. As is known in the art, the term fusion seal refers to a seal formed between two chemically compatible materials such that the two materials cannot be separated due to the strength of the bond created therebetween. In essence, the tacky composition 21 and heat sealable composition are "fused" together. Additionally, the tacky composition 21 must also have sufficient tackiness to temporarily affix the lid 11 to the rim 15 prior to the heat sealing operation.

In one embodiment, in order to ensure that the tacky composition 21 is chemically compatible with the heat sealable composition, similarities in the polarity of the chemical structure of the tacky composition and the heat sealable composition are desirable. For instance, SURLYN® seal layers are polymeric materials having a non-polar polymer backbone and polar functional groups connected thereto. Specifically, the polar functional groups comprise carboxylic acid neutralized with either Zn or Na and the polymer backbone is polyethylene. Thus, when SURLYN® seal layers are used, the tacky composition 21 preferably comprises a non-polymer backbone and polar functional groups, such as carboxylic acid. Examples of materials suitable for use as the tacky composition 21 include ethylene/acrylic acid waxes, ethylene/acrylic acid copolymers, ethylene/methacrylic acid polymers, polyvinyl alcohol pressure sensitive adhesives and mixtures thereof. One commercially available material suitable for use as the tacky composition is NACOR 38-4500 made by National Starch and Chemical Company. The above-listed materials may be suitable for use as the tacky composition 21 where, for example, the heat sealable composition comprises polyethylene, ethylene/methyl acrylate or ionomeric polymers, such as SURLYN® polymer. However, as would be understood by one of ordinary skill in the art, other materials known in the art would be suitable for use as the tacky composition 21.

FIG. 2 also illustrates the sealed end of the tubular container of a preferred embodiment of the present invention wherein the two seal layers, 22, 26 are heat sealed together. Preferably, a sealed composite container for products is provided having a heat seal between the liner ply 14 and the lid 11 in the form of an inner heat seal bead 36 and an outer heat seal bead 38. The inner heat seal bead 36 and the outer heat seal bead 38 are formed of the heat sealable compositions of the seal layer 26 of the liner ply 14 and the seal layer 22 of the lid 11. The heat sealable compositions of both seal layers 22, 26 are displaced outwardly from the intermediate region during the heat sealing operation and are cooled to form the beads 36, 38. The inner heat seal bead 36 faces the interior of the tubular container 10 and the outer heat seal bead 38 is disposed on the opposite side of the heat seal area from the inner heat seal bead 36. When cooled, the heat seal comprises a thin intermediate region between the inner heat seal bead 36 and the outer heat seal bead 36. In certain places, the heat sealable and tacky compositions may be completely displaced from between the barrier layers 20 and 28 such that the barrier layers are in abutting contact. However, the inner and outer beads 36, 38 maintain double barriers against the passage of liquids and gasses so that a hermetic seal is maintained. The intermediate region preferably has a lower bond strength than the inner heat seal bead 36 and the outer heat seal bead 38. The term "bead" as used herein is intended to be distinguished from prior containers having relatively flat heat seal where very little, if any, flowing of the heat seal compositions occurs. In addition, this embodiment is not limited to use with only liners having a straight overlapping seam, but the heat seal beads 36, 38 could also be used with an anaconda fold seam. A preferred construction of this type is disclosed in U.S. patent application Ser. No. 09/065,783 entitled "Tubular Container With a Heat Seal Having an Inner and Outer Bead and Method of Manufacturing Said Container," U.S. Pat. No. 5,979,748, which is assigned to the assignee of the present invention and expressly incorporated herein by reference.

In effect, the inner heat seal bead 36 and the outer heat seal bead 38 provide a double seal having a high tensile or burst strength. The burst strength of the bead seals gives the container 10 a strong seal against forces acting upon the container in a direction normal to the heat seal (i.e., normal to the plane defined by the end of the tubular container 10). Since most forces acting upon a container during storage and transit will occur normal to the heat seal area, the high burst strength of the inner heat seal bead 36 and outer heat seal bead 38 of the present invention is especially advantageous for use with product containers. Burst strength may be tested using an altitude chamber. Typically, the sealed container 10 is placed in the altitude chamber and then subjected to an external partial vacuum for a predetermined period of time to determine whether the heat seal is capable of withstanding differences between interior container pressure and external air pressure. Suitable testing conditions include subjecting the container to a vacuum of 10 in. of Hg for 30 minutes at room temperature. The containers 10 of the present invention are potentially capable of maintaining a hermetic seal during a thirty minute exposure to a vacuum of 10 in. of Hg at room temperature.

Notwithstanding the high burst strength, the peel strength of the heat seal formed according to a preferred embodiment of the present invention is relatively low, resulting in a container that exhibits relative ease of opening. The preferred range for peel strength is about 5 to about 10 lbs./linear inch. In one embodiment, the heat seal has a peel strength of about 7 to about 10 lbs./linear inch. Thus, the heat seal of the present invention combines the shear strength and tensile strength necessary to prevent unwanted breaches of the tubular container 10 with relatively low peel strength for ease of opening by the consumer.

It has been discovered that the inner bead 36 of the double bead seal provides the primary resistance to tensile forces acting upon the container, such as those burst forces generated by changes in internal pressure during transport. However, the outer bead 38 provides the primary resistance to opening by peeling of the peelable heat seal formed between the lid 11 and the liner ply 14. As a result, it has been discovered that the heat seal is advantageously formed having a larger inner bead 36 and a smaller outer bead 38. The resulting container exhibits both improved ease of opening by virtue of the smaller outer bead 38 and improved burst strength for withstanding the rigors of transportation by virtue of the larger inner bead 36.

The containers 10 of the present invention may be manufactured by the process illustrated in FIG. 3. As shown, a continuous strip of paperboard body ply material 13 is supplied to the apparatus and is first passed through a pair of opposed edge shivers 50. The edge shivers remove part of the square edge of the body ply 13 to create first 52 and second 54 edges having a beveled configuration. The body ply 13 is then advanced through an adhesive applicator 56, which applies an adhesive 21 to the upper surface of the body ply 13. The adhesive 21 is advantageously an aqueous adhesive, which overcomes the many problems associated with solvent based adhesives. No special equipment is needed to capture solvents, which evaporate from the adhesive in order to comply with environmental regulations. Preferred adhesives are aqueous low glass transition temperature ethylene vinyl acetate (>18%) materials. One preferred adhesive is No. 72-4172, which is available from the National Starch and Chemical Company. Another adhesive that may be used is No. 33-4060, which is also available from the National Starch and Chemical Company. The adhesive 21, as well as other adhesive layers used to construct the container 10, may be applied in the form of a foam as described in copending U.S. patent application Ser. No. 09/197,275 entitled, "Composite Container Having Foamed Adhesive," which is assigned to the assignee of the present invention and hereby incorporated by reference.

The body ply 13 and wet adhesive 21 applied thereto are then passed underneath a heater 58 which evaporates at least part of the water content of the aqueous adhesive 21 to render the adhesive substantially tacky. It is important that the correct amount of heat is supplied to the adhesive. Insufficient heat will not evaporate enough water in a sufficiently short period of time with the result that the adhesive will not be rendered sufficiently tacky. Conversely, too much heat will overdry the adhesive and cause the adhesive to lose tackiness. A preferred type of heat source is an infrared heater although various other heat sources, e.g., forced air heating or the like can be used. After heating the adhesive 21 on the body ply 13, the body ply 13 and the liner ply 14 are fed to the shaping mandrel from opposite directions. The body ply 13 is passed under skive adhesive applicator 60 which applies the skive adhesive 24 to the beveled surface of the skived second edge 54 of the body ply 13. The skive adhesive 24 is preferably a hot melt adhesive of the type which is conventional in the art, although it could also be a water based adhesive including one or more polymers. Polyvinyl acetate and ethylene vinyl acetate are the preferred liquid adhesives. The skive adhesive 24 helps provide a stronger body ply bond especially for single body ply containers.

The surface of the liner ply 14 that contacts the body ply 13 is subjected to a corona treatment station 62. The opposite surface of liner ply 14 is coated with lubricant from a roller 64, which allows the liner ply to slide smoothly during the winding operation.

The liner ply 14 is then passed under an infrared heater 66, which heats the second marginal edge portion 42 of the liner ply. After the infrared heater 66, the second marginal edge portion 42 of the liner ply 14 is then passed under at least one forced air heater 68.

The body ply 13 and the liner ply 14 are then wrapped around a shaping mandrel 70 from opposite sides of the mandrel. Each ply is first wrapped under the mandrel 70 and then back over the top in a helical fashion with the liner ply 14 wound against the surface of the mandrel. The first marginal edge portion 41 of the liner ply 14 is exposed on the mandrel 70 and is subjected to heat from a second forced air heater 72.

As the body ply 13 is further wrapped and the first edge 52 of the body ply 13 advances back under the mandrel 70 after one complete revolution, it is brought into contact with the second edge 54 of the ensuing portion of the body ply 13 which is first coming into contact with the mandrel. The skived edges 52, 54 become abutted together and the skive adhesive 24 adheres the edges together to form a spirally wound tube which advances along the mandrel 70.

With regard to the liner ply 14, the first marginal edge portion 41 is brought into an overlapping relationship with the second marginal edge portion 42 to create a sealed straight lap seam. The seal is formed by a polymeric adhesive layer 30 of the first marginal edge 41 becoming bonded to the second marginal edge 42. However, a strip of hot melt adhesive could alternatively be used for securing and sealing the liner overlap.

The tube is then advanced down the mandrel 70 by a conventional winding belt 74, which extends around a pair of opposed pulleys 76. The winding belt 74 not only rotates and advances the tube, but also applies pressure to the overlapping edges of the body ply 13 and liner ply 14 to ensure a secure bond between the respective ply edges.

An outer label ply 16 is then preferably passed over an adhesive applicator 78 and wrapped around the body ply 13. The label ply 16 could be applied before the winding belt 74. At a cutting station 80, the continuous tube is cut into discrete lengths and removed from the mandrel 70.

Figure 4:
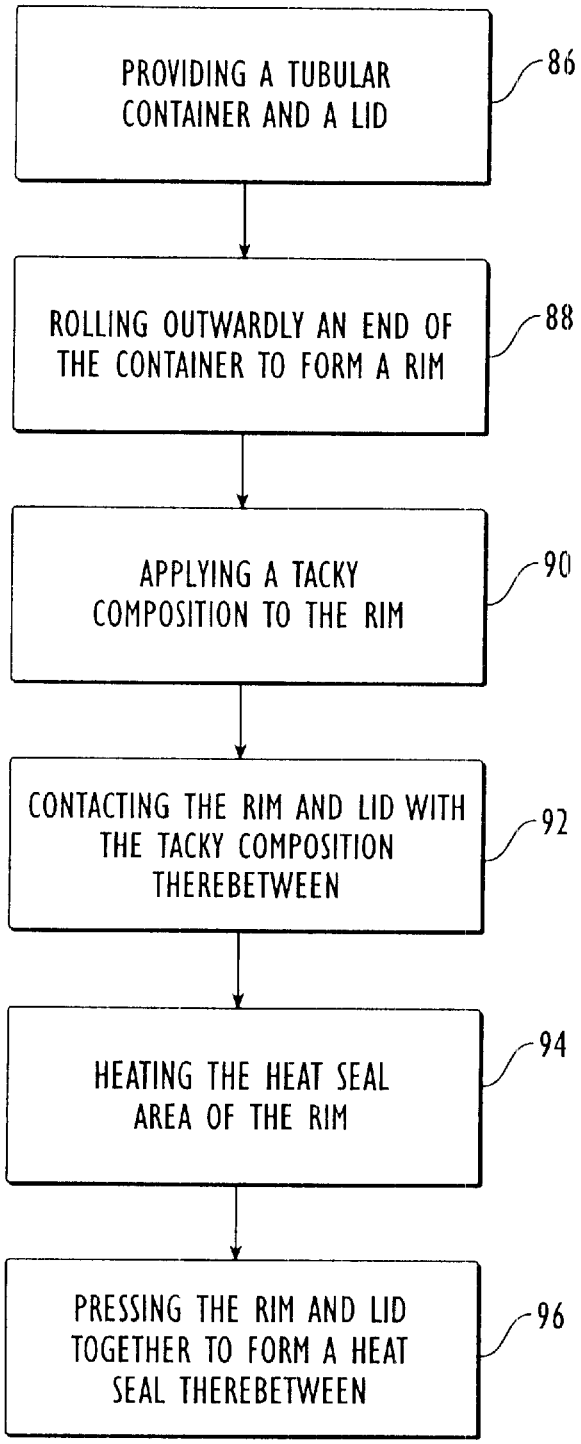
FIG. 4 is a flowchart of a method of sealing a lid to the rim of a container according to the present invention.

A method and apparatus for sealing a container for products is also provided. A preferred sealing method of the present invention is outlined in FIG. 4. As shown in FIG. 4, the heat sealing method of the present invention includes providing a lid and a tubular member having a paperboard layer 13 and liner ply 14 adhered to the inner surface of the paperboard layer (step 86). As described above, a preferred embodiment of the liner ply 14 includes a barrier layer 28 and a seal layer 26, the seal layer defining the innermost surface of the liner ply and comprising a heat sealable composition. An end of the tubular member is rolled outwardly to form a rim 15 (step 88).

A tacky composition 21 is applied to the rim (step 90). The tacky composition 21 may be applied in any manner known in the art. For example, the tacky composition 21 may be applied by coating at least a portion of the outer surface of an applicator with the tacky composition and contacting the coated portion of the outer surface of the applicator with the rim of the container such that an amount of the tacky composition is applied to the rim. The applicator may comprise any type of applicator known in the art including, but not limited to, brushes, rollers and sponges.

As described above, the tacky composition must have sufficient tackiness to temporarily affix the lid on the rim prior to the heat sealing step. The tacky composition 21 is chemically compatible with the heat sealable composition used to form the heat seal between the lid 11 and the rim 15.

A lid 11 is then contacted with the rim 15 with the tacky composition therebetween (step 92). As noted above, a preferred embodiment of the lid 11 includes a barrier layer 20 and a seal layer 22, wherein the seal layer comprises a heat sealable composition. The seal layer 22 of the lid 11 is contacted with the seal layer 26 of the liner ply 14. The tacky composition 21 temporarily affixes the lid 11 to the rim 15 prior to the heat sealing operation.

The heat seal area, and consequently the two seal layers 22, 26, are then heated under conditions sufficient to render the heat sealable compositions flowable (step 94). The rim 15 and lid 11 are pressed together to form a heat seal therebetween (step 96). As described above, the tacky composition 21 of the present invention forms a fusion seal with the heat sealable compositions so that no reduction in seal strength arises from the presence of the tacky composition. Preferably, the rim 15 and lid 11 are pressed together so as to preferentially encourage more flow of the heat sealable compositions in the direction of the interior of the container to form an inner bead 36 and an outer bead 38, wherein the inner bead contains a larger amount of heat sealable compositions than the outer bead.

In a preferred embodiment, the pressing step is accomplished by pressing the seal layers 22, 26 together using an inclined surface, such as an inclined heat sealing head. The heat sealing head is preferably constructed of metal, such as copper. The heat sealing head is heated by a heat source. The heat source may be any suitable type of heat source known in the art. The heat sealing head does not have to be heated. Instead, the heat seal layers 22, 26 could be heated independently using a separate heat source. The heat sealing head has an engaged sealing position in contact with the lid 11 and a disengaged position. The heat sealing head is moved between the two positions by an actuator. The actuator may be any type of actuator known in the art, including mechanical, pneumatic, and the like.

The angle of the inclined surface of the heat sealing head affects the amount of material that flows to form the beads as well as the relative size of the beads. The angle of the inclined surface of the heat sealing head is about 2 to about 20 degrees, preferably about 7 to about 12 degrees. In one embodiment, the angle of the inclined surface is about 10 degrees. In another embodiment, the angle is about 3°. The inclined surface of the head causes molten polymer from the seal layers to move towards the interior of the container to form the inner bead. As this movement occurs, the molten polymer advantageously "fills in" any irregularities in the liner and lid surfaces, thus improving the integrity of the seal.

The heat sealing conditions, such as temperature, pressure, and time, depend on a number of factors, including the heat sealable compositions used and the thickness of the heat seal layers. In one embodiment, the heat seal layers are heated to between about 175° C. to about 275° C., preferably about 205° C. to about 230° C., and most preferably about 210° C. to about 225° C. In one embodiment, the heat sealing temperature is about 218° C. The heat sealing pressure is about 30 to about 60 psi, preferably about 40 to about 50 psi. In one embodiment, the heat sealing pressure is about 45 psi. The heat sealing time, meaning the period of time during which heat sealing pressure is applied, is about 0.5 to about 1.75 seconds, preferably about 0.9 to about 1.5 seconds, and most preferably about 1.15 to about 1.35 seconds. In one embodiment, the heat sealing time is about 1.25 seconds.

Although the container embodiments discussed above include two seal layers, 22 and 26, the present invention does not require the use of two seal layers. At least one of the liner and lid must include a seal layer in order to provide the necessary heat seal. However, two seal layers are not necessary to practice the present invention. If a single heat seal layer is used, the heat seal layer is preferably constructed of ionomeric polymers, such as SURLYN® polymer, high density polyethylene, low density polyethylene, ethylene vinyl acetate, ethylene methyl acrylate, metallocene catalyzed polyolefins and mixtures thereof.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. For example, the tubular containers according to the present invention are not necessarily helically wound but may instead be longitudinally wrapped to create a "convolute" tube having an axially extending seam. In addition, although the tubular containers according to the present invention have been described primarily in connection with food products, it is to be understood that the containers could be used in connection with other products where the liner ply is advantageous such as, for example, ink or caulk. Although specific terms are employed herein, they are used in a generic and descriptive sense only and not for purposes of limitation.

That which is claimed:

1. A sealed composite container for products comprising:

a tubular body member comprising at least one paperboard body ply and comprising an inner surface;

a liner ply adhered to the inner surface of said tubular body member and comprising a barrier layer, at least one end of said body member and said liner ply being rolled outwardly to form a rim and exposing said liner ply;

a lid positioned against said rim, said lid comprising a barrier layer, wherein at least one of said lid and said liner ply further comprises a seal layer comprising a heat sealable composition, said heat sealable composition forming a heat seal between said lid and said liner ply; and a tacky composition in intimate contact with said rim and said lid and operatively positioned therebetween, said tacky composition sufficiently tacky for temporarily holding said lid in place against said rim, said tacky composition further being chemically compatible with said heat sealable composition such that said tacky composition and said heat sealable composition are fusion sealed together.

2. A container according to claim 1, wherein said tacky composition and said heat sealable composition both comprise a polymer material having a non-polar polymer backbone with at least one polar functional group connected thereto.

3. A container according to claim 2, wherein said polar functional group comprises carboxylic acid.

4. A container according to claim 2, wherein said polymer backbone comprises polyethylene.

5. A container according to claim 1, wherein said tacky composition has a melt flow index of about 20 g./10 min. to about 2000 g./10 min.

6. A container according to claim 1, wherein said tacky composition is selected from the group consisting of ethylene/acrylic acid waxes, ethylene/acrylic acid copolymers, ethylene/methacrylic acid polymers, polyvinyl alcohol and mixtures thereof.

7. A container according to claim 1, wherein said seal layer is selected from the group consisting of ionomeric polymers, high density polyethylene, low density polyethylene, ethylene vinyl acetate, ethylene methyl acrylate, metallocene catalyzed polyolefins and mixtures thereof.

8. A container according to claim 1, wherein both of said lid and said liner ply comprise a seal layer.

9. A container according to claim 8, wherein said seal layer of said liner ply is selected from the group consisting of ionomeric polymers, high density polyethylene, low density polyethylene, metallocene catalyzed polyolefins, and mixtures thereof.

10. A container according to claim 8, wherein said seal layer of said lid is selected from the group consisting of ionomeric polymers, ethylene vinyl acetate, high density polyethylene, low density polyethylene, ethylene methyl acrylate, metallocene catalyzed polyolefins and mixtures thereof.

11. A container according to claim 1, wherein said barrier layer of said lid is selected from the group consisting of foil, polyamide, metallized polyamide, polyvinylidiene chloride, polyethylene terephthalate, modified polyethylene terephthalate, metallized polyethylene terephthalate, metallized modified polyethylene terephthalate, polyethylene napthalate, metallized polyethylene napthalate, metallized polypropylene, metal oxide and silicate coated polyester, metal oxide and silicate coated polypropylene, ethylene vinyl alcohol and mixtures thereof.

12. A container according to claim 1, wherein said barrier layer of said liner ply is selected from the group consisting of foil, polyamide, metallized polyamide, polyvinylidiene chloride, polyethylene terephthalate, modified polyethylene terephthalate, metallized polyethylene terephthalate, metallized modified polyethylene terephthalate, polyethylene napthalate, metallized polyethylene napthalate, metallized polypropylene, metal oxide and silicate coated polyester, metal oxide and silicate coated polypropylene, ethylene vinyl alcohol, and mixtures thereof.

* * * * *